US007909162B1

(12) United States Patent
Barrett

(10) Patent No.: US 7,909,162 B1
(45) Date of Patent: Mar. 22, 2011

(54) BARBER'S PORTABLE CASE APPARATUS

(76) Inventor: Donovan S. Barrett, Roosevelt, NY (US)

( * ) Notice: Subject to any disclaimer, the term of this patent is extended or adjusted under 35 U.S.C. 154(b) by 0 days.

(21) Appl. No.: 12/880,261

(22) Filed: Sep. 13, 2010

(51) Int. Cl.
*A45C 11/26* (2006.01)
*B65D 69/00* (2006.01)

(52) U.S. Cl. ..... 206/351; 206/234; 206/702; 132/286; 132/315

(58) Field of Classification Search ..... 206/45.2, 206/45.23, 234, 349, 351, 372, 373, 581, 206/702; 30/34.05; 132/212, 286, 315; 361/643, 361/688, 690; 362/218; 439/501, 577
See application file for complete search history.

(56) References Cited

U.S. PATENT DOCUMENTS 2,458,721 A * 1/1949 Nenno ..... 206/351
3,815,614 A * 6/1974 Waters et al. ..... 206/349
5,075,971 A 12/1991 McCambridge
5,875,794 A * 3/1999 Ekman ..... 132/315
6,095,156 A 8/2000 Smith, II
6,739,053 B2 5/2004 McCambridge et al.
D513,346 S 12/2005 Buck, Jr.
7,320,402 B2 * 1/2008 Lewis ..... 206/320
7,513,361 B1 * 4/2009 Mills, Jr. ..... 206/234
7,617,936 B2 * 11/2009 Barnett, Jr. ..... 206/576
2008/0035507 A1 * 2/2008 Collister et al. ..... 206/349
2010/0089792 A1 * 4/2010 Bryant, Jr. ..... 206/581
* cited by examiner

*Primary Examiner* — Luan K Bui
(74) *Attorney, Agent, or Firm* — Crossley Patent Law; Mark A. Crossley

(57) ABSTRACT

The barber's portable case apparatus provides for storing and carrying multiple barber's tools such as clippers, for example, in a compact arrangement that provides forced air cooling for the tools. The case is designed to adequately and removably contain clippers without being overly large, thereby contributing further to portability and space savings. The multiple electrical outlet may provide for powering the fans and other needed appliances. The apparatus may obviously hold other devices in need of storage and forced air ventilation for cooling. By cooling such tools as clippers, for example, both a barber and a customer are saved any high heat contact common in the use of such implements. A plurality of channels conducts air to the fans.

13 Claims, 4 Drawing Sheets

BARBER'S PORTABLE CASE APPARATUS

BACKGROUND OF THE INVENTION

The use of electric barber's clippers is ubiquitous, as are problems associated with the clippers becoming hot. Hot clippers are not easily handled and, more importantly, can be both unpleasant and injurious to customers. Additionally, heat buildup is detrimental to the life of clippers. Another issue faced is that a barber must often be highly portable in the practice of their skills. A further concern is clipper storage. The present apparatus solves these problems.

FIELD OF THE INVENTION

The barber's portable case apparatus relates to barber tool storage and more especially to a compact, portable clipper and tool storage apparatus that provides chambered, directed air to cool clippers and other tools, and provides a plurality of electrical outlets.

SUMMARY OF THE INVENTION

The general purpose of the barber's portable case apparatus, described subsequently in greater detail, is to provide a barber's portable case apparatus which has many novel features that result in an improved barber's portable case apparatus which is not anticipated, rendered obvious, suggested, or even implied by prior art, either alone or in combination thereof.

To attain this, the barber's portable case apparatus provides for storing and carrying multiple barber's tools such as clippers, for example, in a compact arrangement. The case is designed to adequately and removably contain clippers without being overly large, thereby contributing further to portability and space savings. Additionally, the power cord of the apparatus may be removably disposed within the optional multiple electrical outlet and aids in portability. The multiple electrical outlet may provide for powering the fans and other needed appliances. The ideal embodiment of the apparatus may contain 4 or more open topped chambers for holding tools such as barber tools. The apparatus may obviously hold other devices in need of storage and forced air ventilation for cooling. By cooling such tools as clippers, for example, both a barber and a customer are saved any high heat contact common in the use of such implements. The apparatus may comprise one cooling fan for each open topped chamber. A plurality of channels may conduct air to any number of fans. Additionally, a barber's tools used are spared excessive taxation and premature failure by cooling.

Thus has been broadly outlined the more important features of the improved barber's portable case apparatus so that the detailed description thereof that follows may be better understood and in order that the present contribution to the art may be better appreciated.

An object of the barber's portable case apparatus is to provide a portable carry case for barber supplies.

Another object of the barber's portable case apparatus is to provide a plurality of forced cooling fans for barber tools.

A further object of the barber's portable case apparatus is to provide multiple separate chambers for various barber tools.

An added object of the barber's portable case apparatus is to provide for covering and protecting barber tools.

And, an object of the barber's portable case apparatus is to provide multiple removable power cords for the apparatus' fans.

Still another object of the barber's portable case apparatus is to provide a plurality of electrical outlets for powering various needed devices.

These together with additional objects, features and advantages of the improved barber's portable case apparatus will be readily apparent to those of ordinary skill in the art upon reading the following detailed description of presently preferred, but nonetheless illustrative, embodiments of the improved barber's portable case apparatus when taken in conjunction with the accompanying drawings.

DETAILED DESCRIPTION OF THE DRAWINGS

With reference now to the drawings, and in particular FIGS. 1 through 5 thereof, the principles and concepts of the barber's portable case apparatus generally designated by the reference number 10 will be described.

Figure 1:
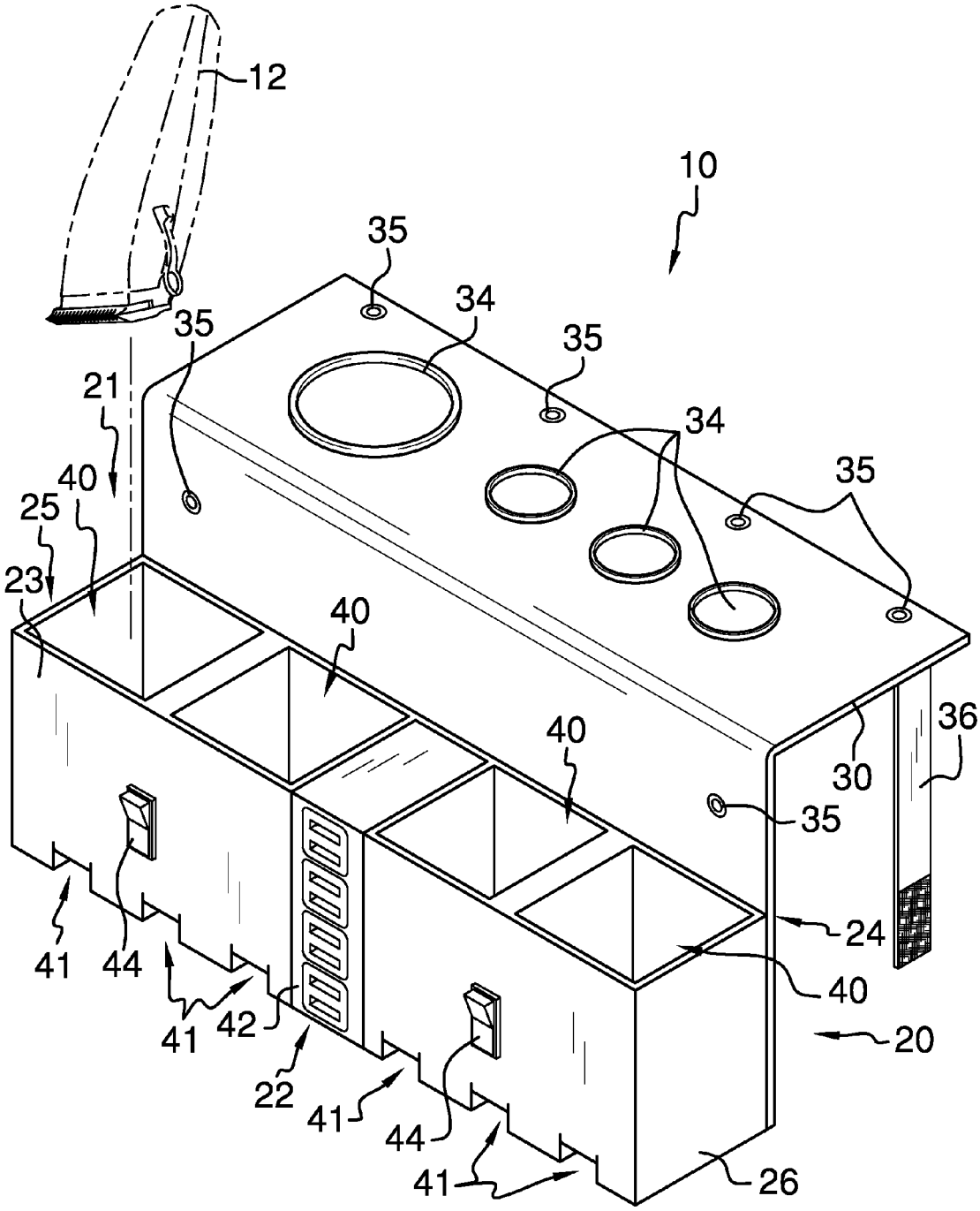
FIG. 1 is a top perspective view, folding lid open.

Referring to FIG. 1, the apparatus 10 comprises a top 21 spaced apart from a bottom 22, a front 23 spaced apart from a back 24, and a first end 25 spaced apart from a second end 26. The case 20 is extended from the top 21 to the bottom 22, from the front 23 to the back 24, and from first end 25 to the second end 26.

Figure 2:
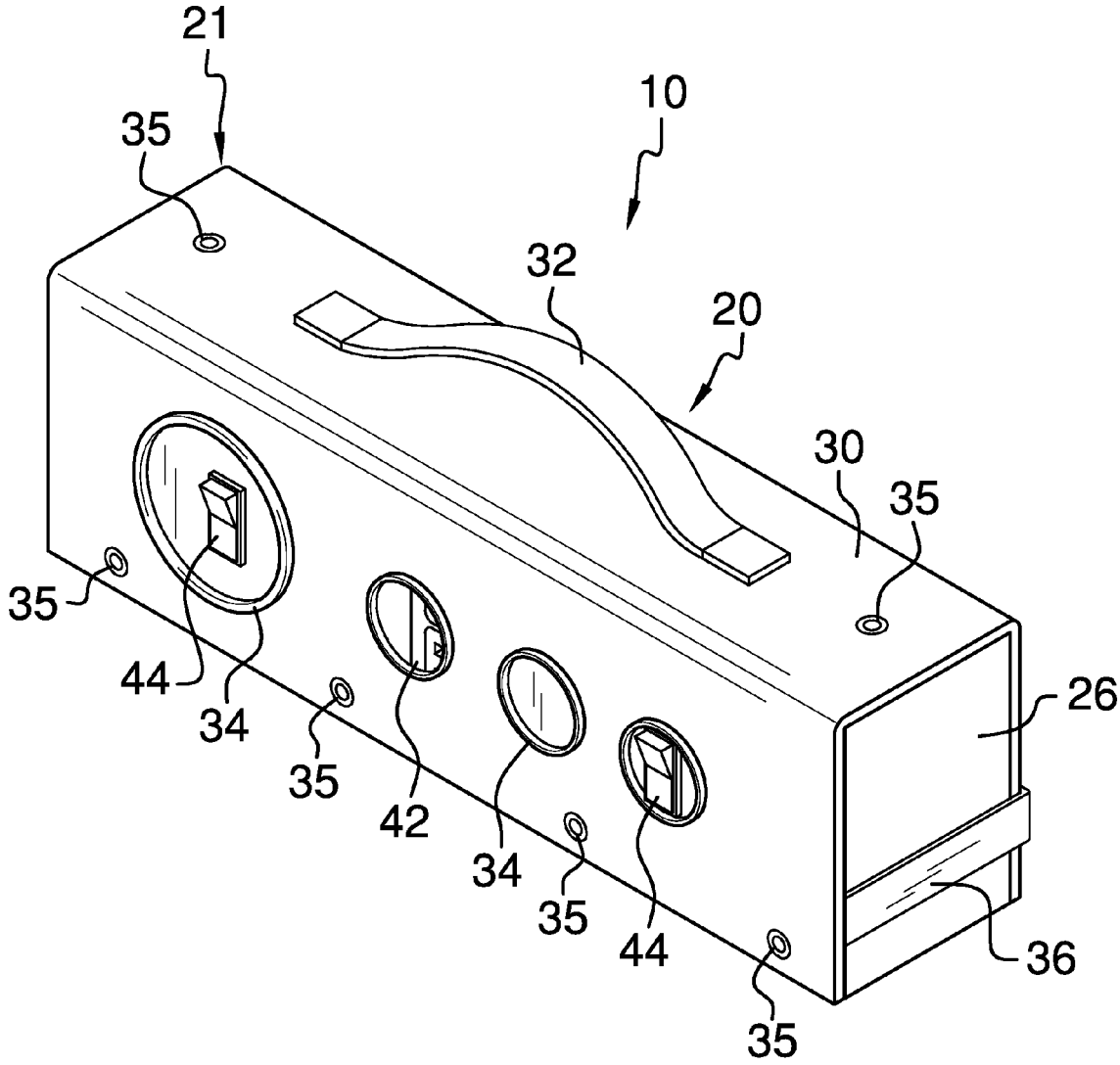
FIG. 2 is a top perspective view, folding lid closed.

Referring to FIG. 2, the folding lid 30 selectively covers the case 20 top 21 and the case 20 front 23 and is attached at the case 20 back 24 top 21. The handle 32 is disposed on the folding lid 30 over the case 20 top 21.

Referring to FIG. 3 and again to FIG. 2, the pair of straps 36 is affixed to the folding lid 30 selectively covering the case 20 front 23. One strap 36 is disposed on the first end 25 and one strap 36 is disposed on the second end 26. The straps 36 are selectively fastened to the case 20 back 24 with the folding lid 30 in the closed position, thereby providing an advantageous method of protection for the case 20 and for any barber tools, such as the clipper 12 held within the case 20. A plurality of spaced apart ports 34 is disposed in the folding lid 30 covering the case 20 front 23. The ports 34 allow access to the switches 44 and the multiple electrical outlet 42 with the folding lid 30 in a closed position. The plurality of spaced apart holes 35 is disposed in the folding lid 30 covering the case 20 top 21 and the case 20 front 23. The holes 35 provide for sturdily hanging the case 20 as desired.

Figure 5:
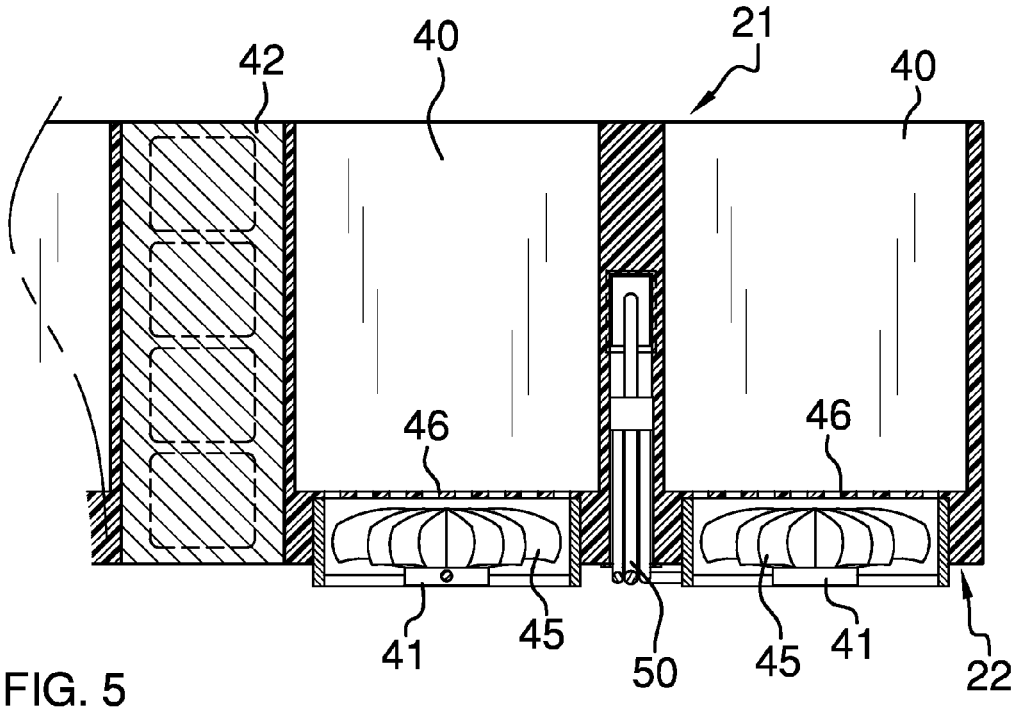
FIG. 5 is a cross sectional view of FIG. 4, taken along the line 5-5.

Referring again to FIG. 1 and also to FIG. 5, the plurality of open topped chambers 40 is disposed within the case 20, from the first end 25 to the second end 26. A fan 45 is disposed within each chamber 40. Each fan 45 is disposed adjacent to the case 20 bottom 22. The multiple electrical outlet 42 is disposed centrally within the case 20. The outlet 42 is frontally exposed.

Figure 3:
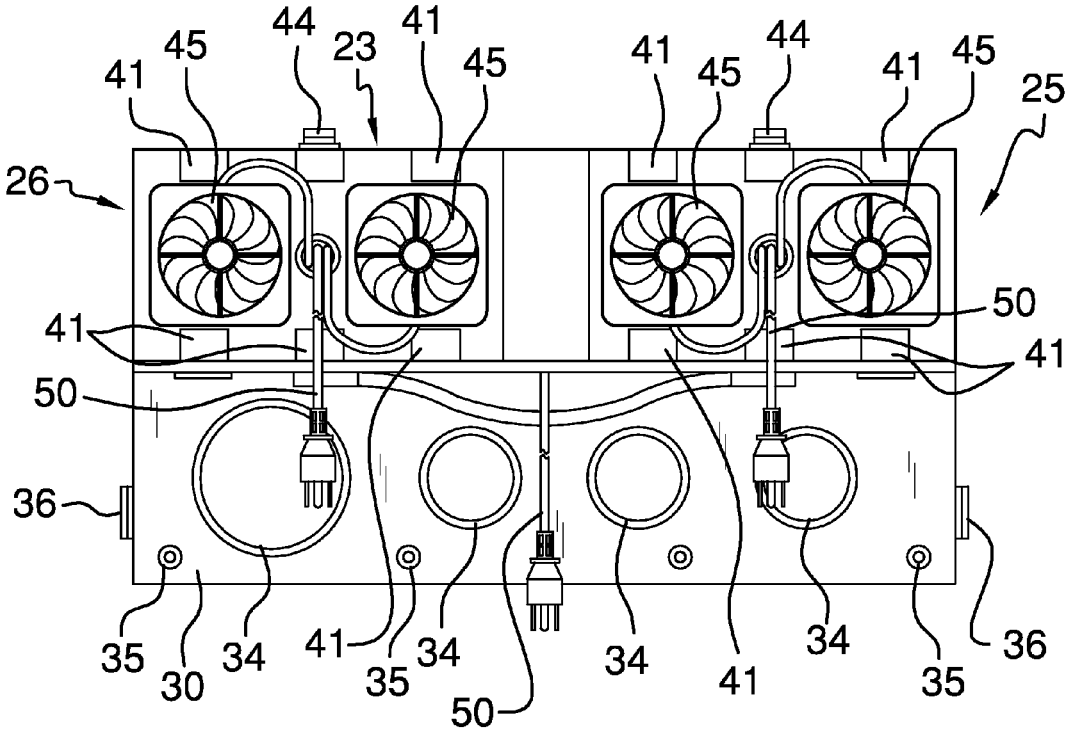
FIG. 3 is a bottom plan view, folding lid open.

Referring to FIG. 1 and to FIG. 3, an individual power cord 50 powers each of a pair of fans 45. Each power cord 50 exit is the case 20 bottom 22. An additional power cord 50 is removably disposed within the multiple electrical outlet 42. The additional power cord 50 powers the outlet 42 from a given power source.

Referring again to FIGS. 1 and 2, the pair of spaced apart switches 44 is disposed within the case 20 front 23. Each switch 44 powers one pair of fans 45. Each switch 44 is accessible through the folding lid 30 with the lid 30 in a closed position, via the ports 34.

Referring again to FIG. 3 and to FIG. 5, the plurality of channels 41 is disposed in the case 20 bottom 22. The channels 41 are in communication with the fans 45 such that air flow is supplied thereto.

Figure 4:
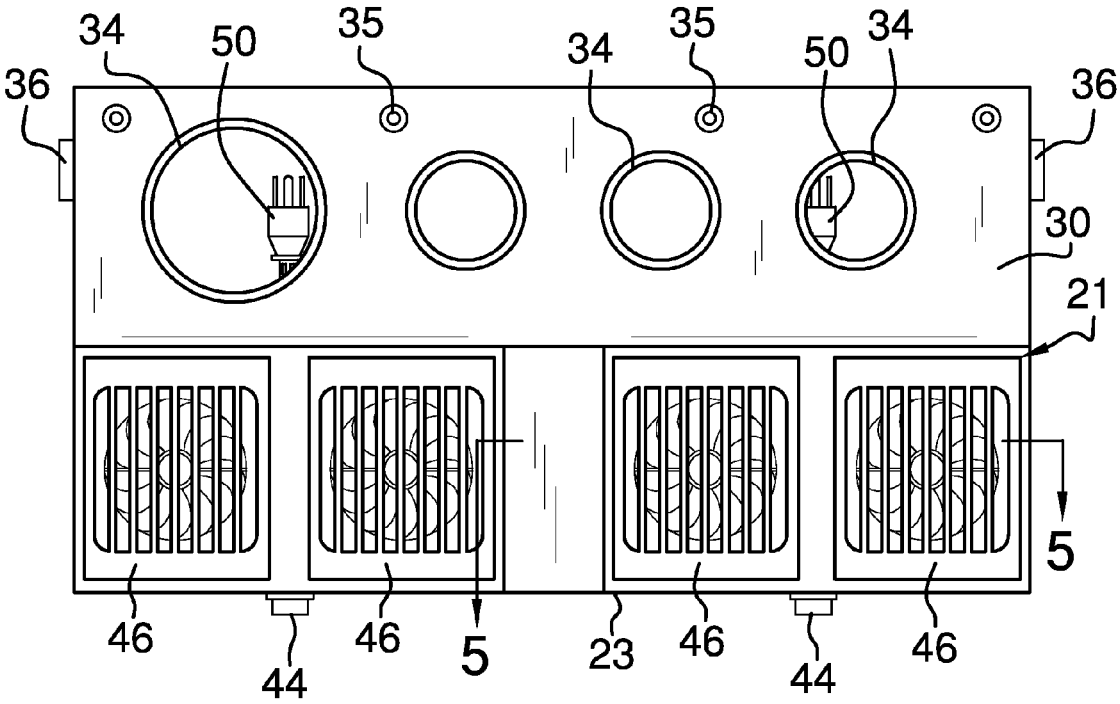
FIG. 4 is a top plan view, folding lid open.

Referring to FIGS. 4 and 5, a grate 46 is disposed immediately atop each fan 45 and thereby negates invasion of each fan 45 by equipment or debris. With fans 45 operated by switches 44, air is channeled through the channels 41 and upwardly through each grate 46 into and through each chamber 40.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the barber's portable case apparatus may be used.

What is claimed is:

1. A barber's portable case apparatus comprising, in combination:

a top spaced apart from a bottom, a front spaced apart from a back, and a first end spaced apart from a second end;

a case extended from the top to the bottom, the front to the back, and the first end to the second end;

a plurality of open topped chambers disposed within the case, from the first end to the second end;

a fan disposed within the case adjacent to the case bottom;

an electrical outlet disposed centrally within the case, the outlet frontally exposed;

a power cord powering the fan, the power cord exiting the case bottom;

an additional power cord removably disposed within the electrical outlet, the additional power cord powering the outlet;

a switch disposed within the case front, the switch in communication with the electrical outlet and the fan;

a plurality of channels disposed in the case bottom, the channels in communication with the fan;

a grate disposed immediately atop the fan;

whereby air is channeled through the channels and upwardly through the grate into and through each chamber.

2. The apparatus according to claim 1 wherein the electrical outlet further comprises a multiple electrical outlet.

3. The apparatus according to claim 1 further comprising a fan disposed within each chamber, each fan disposed adjacent to the case bottom;

a grate disposed immediately above each fan.

4. The apparatus according to claim 2 further comprising a fan disposed within each chamber, each fan disposed adjacent to the case bottom;

a grate disposed immediately above each fan.

5. The apparatus according to claim 1 further comprising a folding lid selectively covering the case top and the case front.

6. The apparatus according to claim 2 further comprising a folding lid selectively covering the case top and the case front.

7. The apparatus according to claim 3 further comprising a folding lid selectively covering the case top and the case front.

8. The apparatus according to claim 4 further comprising a folding lid selectively covering the case top and the case front.

9. The apparatus according to claim 5 wherein the folding lid is further attached at the case back top;

a handle disposed on the folding lid over the case top.

10. The apparatus according to claim 6 wherein the folding lid is further attached at the case back top;

a handle disposed on the folding lid over the case top.

11. The apparatus according to claim 7 wherein the folding lid is further attached at the case back top;

a handle disposed on the folding lid over the case top.

12. The apparatus according to claim 8 wherein the folding lid is further attached at the case back top;

a handle disposed on the folding lid over the case top.

13. A barber's portable case apparatus comprising, in combination:

a top spaced apart from a bottom, a front spaced apart from a back, and a first end spaced apart from a second end;

a case extended from the top to the bottom, the front to the back, and the first end to the second end;

a folding lid selectively covering the case top and the case front;

a handle disposed on the folding lid over the case top;

a pair of straps affixed to the folding lid selectively covering the case front, a one strap disposed on the first end, a one strap disposed on the second end, the straps selectively fastened to the case back with the folding lid in a closed position;

a plurality of spaced apart ports disposed in the folding lid covering the case front;

a plurality of spaced apart holes disposed in the folding lid covering the case top and the case front;

a plurality of open topped chambers disposed within the case, from the first end to the second end;

a fan disposed within each chamber, each fan disposed adjacent to the case bottom;

a multiple electrical outlet disposed centrally within the case, the outlet frontally exposed;

an individual power cord powering each of an each pair of fans, each power cord exiting the case bottom;

an additional power cord removably disposed within the multiple electrical outlet, the additional power cord powering the outlet;

a pair of spaced apart switches disposed within the case front, each switch powering one pair of fans, each switch accessible through the folding lid in a closed position via the ports;

a plurality of channels disposed in the case bottom, the channels in communication with the fans;

a grate disposed immediately atop each fan;

whereby air is channeled through the channels and upwardly through each grate into and through each chamber.

* * * * *